US008991685B2

(12) United States Patent
McPeak

(10) Patent No.: US 8,991,685 B2
(45) Date of Patent: Mar. 31, 2015

(54) PARTITION

(71) Applicant: RTS Packaging LLC, Norcross, GA (US)

(72) Inventor: Ashley J. McPeak, Norcross, GA (US)

(73) Assignee: RTS Packaging LLC, Norcross, GA (US)

( * ) Notice: Subject to any disclaimer, the term of this patent is extended or adjusted under 35 U.S.C. 154(b) by 234 days.

(21) Appl. No.: 13/670,516

(22) Filed: Nov. 7, 2012

(65) Prior Publication Data

US 2013/0112740 A1 May 9, 2013

Related U.S. Application Data

(60) Provisional application No. 61/557,454, filed on Nov. 9, 2011.

(51) Int. Cl.
*B65D 5/492* (2006.01)
*B65D 5/49* (2006.01)

(52) U.S. Cl.
CPC ..... *B65D 5/48028* (2013.01)
USPC ..... 229/120.38; 229/120.26; 229/120.22

(58) Field of Classification Search
CPC ..... B65D 5/48024; B65D 5/48028; B65D 5/48034; B65D 5/48044; B65D 5/48048; B65D 25/04
USPC ..... 229/120.38, 122.23, 120.26
See application file for complete search history.

(56) References Cited

U.S. PATENT DOCUMENTS

| | | | | |
|---|---|---|---|---|
| 1,306,796 | A | | 6/1919 | Boswell et al. |
| 2,013,240 | A | * | 9/1935 | Harvey ..... 217/30 |
| 3,014,632 | A | | 12/1961 | Kuchenbecker |
| 3,300,076 | A | | 1/1967 | Wohl |
| 3,412,920 | A | | 11/1968 | Desforges |
| 3,580,471 | A | | 5/1971 | Burke et al. |
| 3,715,280 | A | | 2/1973 | Farmer, III |
| 3,756,496 | A | | 9/1973 | Oostdik |
| 3,834,074 | A | | 9/1974 | Shirouzu |
| 3,843,039 | A | | 10/1974 | Brown et al. |
| 3,880,343 | A | | 4/1975 | Rockefeller |

(Continued)

FOREIGN PATENT DOCUMENTS

| | | |
|---|---|---|
| AR | 050390 | 10/2006 |
| CL | 1568-06 | 12/2006 |

(Continued)

OTHER PUBLICATIONS

Chile Patent Application No. 2801-11, Examination Report, Nov. 21, 2013, 7 pages (no English translation available).

(Continued)

*Primary Examiner* — Justin Larson
*Assistant Examiner* — Phillip Schmidt
(74) *Attorney, Agent, or Firm* — Kilpatrick Townsend & Stockton LLP

(57) ABSTRACT

Disclosed are partitions formed from a single blank that can be folded and glued on standard machinery, and that can be folded into an erected partition and loaded with product into a container using standard machinery. In certain embodiments, the partitions have a universal nature due to the curvilinear nature of the flaps of the partitions, which allow the partition to be used with bottles and other product of different dimensions.

15 Claims, 3 Drawing Sheets

(56) References Cited

U.S. PATENT DOCUMENTS

| | | | | |
|---|---|---|---|---|
| 3,921,891 | A | 11/1975 | Gorham | |
| 3,931,924 | A | 1/1976 | Gardner et al. | |
| 3,942,709 | A | 3/1976 | Gepfer | |
| 3,942,837 | A | 3/1976 | Engle | |
| 3,982,684 | A | 9/1976 | David | |
| 3,985,286 | A | 10/1976 | Hicks | |
| 3,997,102 | A * | 12/1976 | Jones | 229/120.26 |
| 4,030,659 | A | 6/1977 | Gardner | |
| 4,030,660 | A | 6/1977 | Rada et al. | |
| 4,096,984 | A | 6/1978 | Gardner | |
| 4,111,350 | A | 9/1978 | Hambleton | |
| 4,120,442 | A | 10/1978 | Skaggs | |
| 4,130,235 | A | 12/1978 | Killy | |
| 4,143,804 | A | 3/1979 | Visvydas | |
| 4,144,995 | A | 3/1979 | Travis | |
| 4,155,501 | A | 5/1979 | Young | |
| 4,157,156 | A | 6/1979 | Skaggs | |
| 4,209,125 | A | 6/1980 | Helms | |
| 4,211,355 | A | 7/1980 | Skaggs | |
| 4,219,146 | A | 8/1980 | Skaggs et al. | |
| 4,249,691 | A | 2/1981 | Gardner | |
| 4,272,008 | A | 6/1981 | Wozniacki | |
| 4,280,650 | A | 7/1981 | Gardner et al. | |
| 4,282,999 | A | 8/1981 | Moen | |
| 4,294,398 | A | 10/1981 | Chidsey, Jr. | |
| 4,299,351 | A | 11/1981 | Gardner | |
| 4,320,867 | A | 3/1982 | Gardner | |
| 4,335,842 | A | 6/1982 | Bradford et al. | |
| 4,361,264 | A | 11/1982 | Philips | |
| 4,470,539 | A | 9/1984 | Skillen | |
| 4,516,717 | A | 5/1985 | Curran | |
| 4,621,764 | A | 11/1986 | Ragon | |
| 4,703,855 | A | 11/1987 | Moe et al. | |
| 4,756,469 | A | 7/1988 | Hansen | |
| 4,850,948 | A | 7/1989 | Schmitz | |
| 5,201,421 | A | 4/1993 | Maier | |
| 5,332,149 | A | 7/1994 | Gepfer | |
| 5,597,113 | A | 1/1997 | Bradford | |
| 5,601,521 | A | 2/1997 | Plamas Xapelli | |
| 5,785,239 | A | 7/1998 | Campbell, II et al. | |
| 2003/0222129 | A1 * | 12/2003 | Williams | 229/120.31 |
| 2004/0112947 | A1 | 6/2004 | Davidson | |
| 2007/0095883 | A1 * | 5/2007 | Boehm | 229/120.36 |
| 2008/0119343 | A1 * | 5/2008 | Zoeckler | 493/160 |

FOREIGN PATENT DOCUMENTS

| | | | |
|---|---|---|---|
| CZ | 10316629 | A1 | 11/2004 |
| DE | 4340010 | A1 | 6/1995 |
| EP | 0681963 | A1 | 11/1995 |
| EP | 1736413 | B1 | 12/2006 |
| EP | 2592009 | | 5/2013 |
| FR | 1138977 | A | 6/1957 |
| FR | 2617802 | A1 | 1/1989 |
| FR | 2791638 | A1 | 10/2000 |
| FR | 2806063 | A1 | 9/2001 |
| GB | 2389573 | | 12/2003 |
| JP | 48076085 | U | 9/1973 |
| JP | 06293330 | A | 10/1994 |
| WO | 9006264 | A1 | 6/1990 |

OTHER PUBLICATIONS

European Patent Application No. EP12191572.2, Extended Search Report, Jan. 14, 2013, 6 pages.

Search Report and Written Opinion dated Dec. 14, 2012 in European Application No. 12191572.

* cited by examiner

PARTITION

CROSS-REFERENCE TO RELATED APPLICATION

This application claims the benefit of U.S. Provisional Application No. 61/557,454 filed on Nov. 9, 2011, the contents of which are incorporated herein by reference.

FIELD OF THE INVENTION

Embodiments generally relate to partitions.

BACKGROUND

Partitions are sometimes used to separate the interior of a container or box into a plurality of cells to prevent items such as bottles from breaking or becoming damaged during shipping and handling. Many partitions are formed by assembling together a plurality of individual pieces. While capable of being shipped to a user in a relatively flat position, partitions formed using a plurality of pieces require the user to either manually assemble and erect the partition for use or to utilize specialized machinery to assemble and erect the partition for use.

Some partitions require intricate folding and/or tabbing and/or gluing to erect the partition, which requires either manual assembly or assembly by specialized machines, both of which are expensive and time consuming.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Generally, according to one aspect, disclosed is a partition formed from a single piece of foldable material comprising a first panel, a second panel, and a third panel, wherein the first panel is adhered at least partially to the third panel so that the first panel forms a first flap and a second flap, wherein the second panel is adhered at least partially to the third panel so that the second panel forms a third flap and a fourth flap, and wherein a first portion of the third panel corresponds to a first center panel and a second portion of the third panel corresponds to a second center panel. Moreover, the first flap and the first center panel define a first cell configured to receive a first item, the first flap and the second flap define a second cell configured to receive a second item, the second flap and the second center panel define a third cell configured to receive a third item, the second center panel and the fourth flap together form a fourth cell configured to receive a fourth item, the fourth flap and the third flap define a fifth cell configured to receive a fifth item, and the third flap and the first center panel define a sixth cell configured to receive a sixth item.

According to another aspect, the foldable material is comprised of a flexible material so that the first, second, third, and fourth flaps are configured to generally conform to product housed in any of the first, second, third, fourth, fifth, or sixth cells.

According to another aspect, the foldable material has a thickness of between approximately 15 thousandths of an inch and approximately 40 thousandths of an inch.

According to another aspect, the first panel is adhered to the third panel along a middle portion of the first panel and along a middle portion of the third panel.

According to another aspect, the second panel is adhered to the third panel along a middle portion of the second panel and along a middle portion of the third panel.

According to another aspect, the partition has a leading edge that is generally wedge-shaped.

According to another aspect, disclosed is a unitary blank comprising a first panel, a second panel and a third panel each comprising a top and a bottom edge, wherein the second panel is positioned between the first and third panels. The unitary blank also comprises a first cut line that separates an upper portion of the first panel from an upper portion of the second panel and a second cut line that separates a lower portion of the first panel from a lower portion of the second panel, wherein the first panel is foldably connected to the second panel at a first center portion located between the first cut line and the second cut line. The unitary blank further comprises a third cut line that separates an upper portion of the second panel from an upper portion of the third panel and a fourth cut line that separates a lower portion of the second panel from a lower portion of the third panel, wherein the second panel is foldably connected to the third panel at a second center portion located between the third cut line and the fourth cut line.

According to another aspect, the top edge of the third panel extends beyond the top edges of the first and second panels, and wherein the bottom edge of the third panel extends beyond the bottom edges of the first and second panels.

According to another aspect, the blank is formed of a flexible material having a thickness of between approximately 15 thousandths of an inch and approximately 40 thousandths of an inch.

According to another aspect, dimensions of the first and second panels are substantially equal.

According to another aspect, the blank comprises at least one glue area.

According to another aspect, disclosed is a single blank comprising a first panel that is adjacent a second panel that is adjacent a third panel, a first cut line that extends from an edge of the first panel to an edge of the second panel, and a second cut line that extends from the edge of the first panel to the edge of the second panel, wherein the first and second cut lines divide the first panel into a first flap, a second flap, and a third flap and divide the second panel into a fourth flap, a fifth flap, and a sixth flap.

According to another aspect, the first, second, and third panels each comprise top and bottom edges and wherein the top edge of the third panel extends beyond the top edges of the first and second panels and wherein the bottom edge of the third panel extends beyond the bottom edges of the first and second panels.

According to another aspect, the blank has a thickness ranging from approximately 15 thousandths of an inch and approximately 40 thousandths of an inch.

According to another aspect, the blank comprises at least one glue area.

According to another aspect, the fourth flap of the second panel is separated from an upper portion of the third panel by a first cut line.

According to another aspect, the sixth flap of the second panel is separated from a lower portion of the third panel by a second cut line.

According to another aspect, the first flap of the first panel is separated from the fourth flap of the second panel by a third cut line.

According to another aspect, the second flap of the first panel is separated from the fifth flap of the second panel by a fold line.

According to another aspect, the third flap of the first panel is separated from the sixth flap of the second panel by a fourth cut line.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
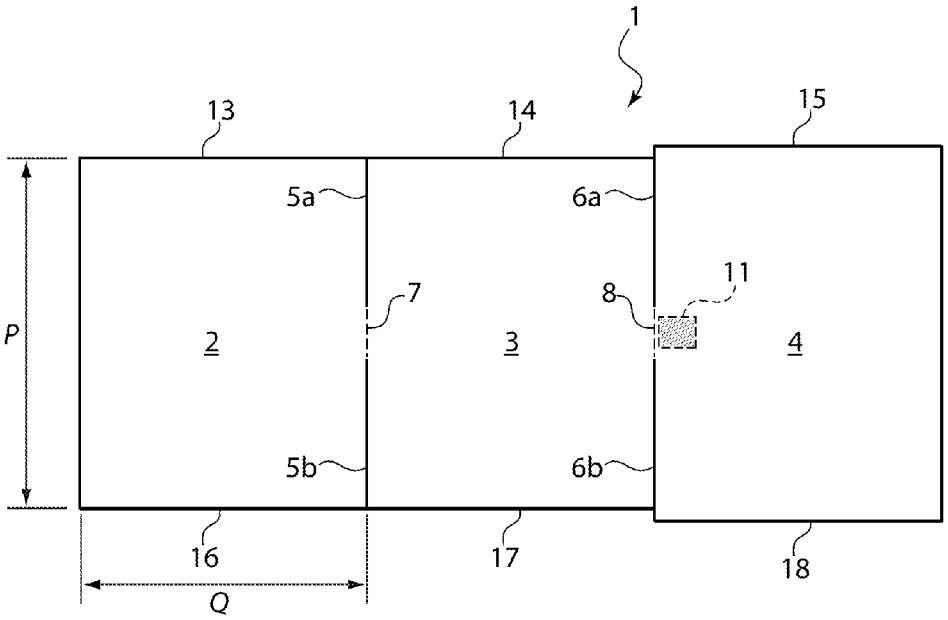
FIG. 1 is a plan view of a unitary blank of foldable material which may be folded and glued into a partition according to one embodiment.

Referring now to the drawings for a better understanding of the invention, FIG. 1 illustrates a single blank of foldable material 1 such as, but not limited to, paperboard, chip board, or corrugated board. In some embodiments, the blank may have a thickness of between approximately 15 thousandths of an inch and approximately 40 thousandths of an inch, although the blank may have any suitable thickness and such thickness may vary depending on the product the partition is intended to protect and/or the density of the blank. As illustrated, blank 1 includes three adjacent panels 2, 3, and 4. In some embodiments, panels 2, 3, and 4 are generally rectangular in shape, although the panels may have any suitable shape. Panels 2, 3, and/or 4 may be substantially equal in the dimension Q, but the dimension Q of each or all of the panels 2, 3, and 4 may vary from one another. Specifically, panel 3 may be larger than the other panels to keep panel 4 from binding when the blank is folded. Also in some embodiments, two of the panels (panels 2 and 3 as illustrated) are substantially equal in the dimension P, while the top edge 15 of one of the panels (panel 4 as illustrated) extends slightly beyond the top edges 13, 14 of panels 2 and 3, respectively, and the bottom edge 18 of panel 4 extends slightly beyond the bottom edges 16, 17 of panels 2 and 3, respectively. In other embodiments, all three panels 2, 3, and 4 have substantially the same dimensions.

In the configuration where one of the panels (panel 4 as shown) includes top 15 and bottom 18 edges that extend beyond the top 13, 14 and bottom edges 16, 17 of panels 2 and 3, this configuration helps ensure even and consistent folding of the blank 1 into an assembled partition. Moreover, having one panel with greater dimensions than the dimensions of the other two panels aids in the insertion of the partition into a container and aids in the separation of the flaps on panels 2 and 3 from panel 4, as described with respect to FIG. 4 below.

As shown in FIG. 1, blank 1 includes cut lines 5*a* and 5*b* that separate panels 2 and 3. Fold line 7 is positioned between cut lines 5*a* and 5*b* so that panels 2 and 3 are foldably connected to one another along fold line 7. Blank 1 also includes cut lines 6*a* and 6*b* that separate panels 3 and 4. Fold line 8 is positioned between cut lines 6*a* and 6*b* so that panels 3 and 4 are foldably connected to one another along fold line 8. Blank 1 also includes at least one glue area, such as glue area 11 located on the rear side of panel 4, although more or less glue areas could be used. The glue area(s) may also be positioned differently than illustrated.

Figure 3:
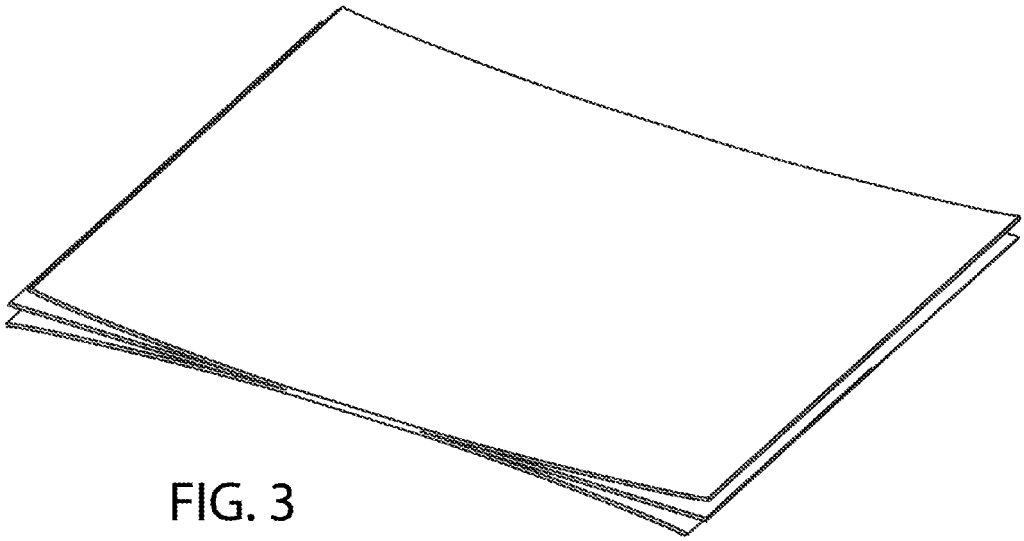
FIG. 3 is a perspective view of a partially assembled and knocked-down flat partition formed from the blank of FIG. 1.

Blank 1 may be folded into a knock-down flat (KDF) configuration using standard machinery, such as a standard flexo/folder/gluer machine The machine folds panel 4 over onto panel 3, and then adhesive is applied on the rear side of panel 4 at glue area 11 and panel 2 is folded onto panel 3 to assemble the partition into its KDF configuration. The adhesive applied at glue area 11 on the backside of panel 4 binds panels 2 and 4 together. In some embodiments, the now partially assembled blank is then passed through a roller which applies pressure to the folded partition and further binds panel 2 to panel 4 at glue area 11. FIG. 3 illustrates an embodiment of the partially assembled blank in its KDF configuration that is ready for shipment.

Figure 2:
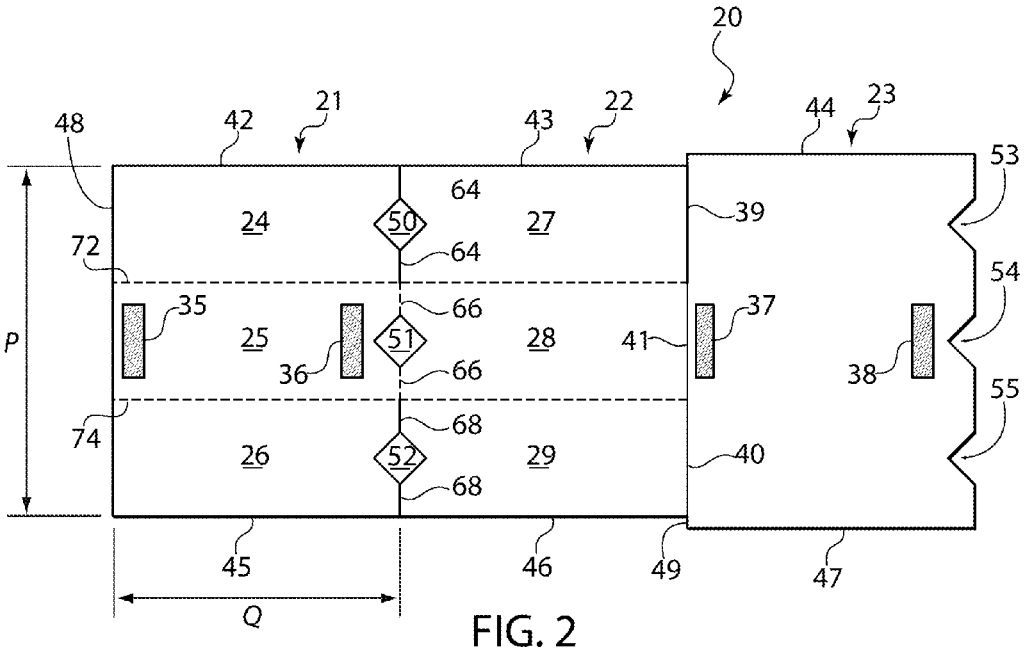
FIG. 2 is plan view of a unitary blank of foldable material which may be folded and glued into a partition according to another embodiment.

FIG. 2 illustrates another embodiment of a single blank from which a partition is formed. Blank 20 may be formed of a foldable material such as paperboard, chip board, or corrugated board. In some embodiments, the blank may have a thickness of between approximately 15 thousandths of an inch and approximately 40 thousandths of an inch, although the blank may have any suitable thickness and such thickness may vary depending on the product the partition is intended to protect and/or the density of the blank. As illustrated, blank 20 includes three adjacent panels 21, 22 and 23. Panels 21, 22 and 23 are all generally rectangular in shape and are substantially the same in dimension Q, although the panels may have any suitable shape and may not be substantially the same in dimension Q. Panels 21 and 22 as shown have substantially equal dimensions, although they need not. In some embodiments, two of the panels (panels 21 and 22 as illustrated) are substantially equal in dimension P, while the top edge 44 of one of the panels (panel 23 as illustrated) extends slightly beyond the top edges 42, 43 of panels 21 and 22, respectively, and the bottom edge 47 of panel 23 extends slightly beyond the bottom edges 45, 46 of panels 21 and 22, respectively. In other embodiments, all three panels 21, 22, and 23 have substantially the same dimensions.

In embodiments where the dimension P of one of the panels (panel 23 as illustrated) is greater than the dimension P of the other panels, such a configuration aids in even and consistent folding of the panels into a partially assembled partition. In addition, the extension of the top 44 and bottom 47 edges of panel 23 beyond the top 42, 43 and bottom edges 45, 46 of panels 21 and 22, respectively, aids in the insertion of the partition into a container and aids in the separation of flaps 24, 26, 27, and 29 on panels 21 and 22 away from panel 23 for insertion into the container.

As shown in FIG. 2, blank 20 includes score lines 72 and 74 that generally extend from an outer edge 48 of panel 21 to an inner edge 49 of panel 23. These score lines divide panel 21 into three portions 24, 25, 26 and divide panel 22 into three portions 27, 28, and 29. Score lines 72 and 74 may be perforation lines, fold lines, or other suitable lines of weakness. Portion 24 is separated from portion 27 via cut line 64, while portion 25 is separated from portion 28 by fold line 66, and portion 26 is separated from portion 29 via cut line 68. Panels 21 and 22 are foldably connected to one another via fold line 66 located between portions 25 and 28. Portions 24, 26, 27, and 29 define flaps in the assembled partition. Panels 22 and 23 are separated from one another via cut lines 39 and 40 but are foldably connected via fold line 41. Blank 20 also includes glue areas 35, 36, 37, and 38, although more or less glue areas may be used and glue areas may be located at other suitable locations along blank 20. For instance, glue area 11 of blank 1 may be used instead of glue areas 35-38. The use of glue is optional, and the folded partition may be held in place using other means, for example but not limited to, staples or by the interaction of features on one panel engaging with features on another panel.

The partition shown in FIG. 2 also includes optional notches 50, 51, and 52 separating panels 24, 27 and 25, 28 and 26, 29, respectively. Optional notches 53, 54, 55 may be generally diamond shaped as shown in FIG. 2, although the notches may have any suitable shape. Notches 53, 54, 55 align with notches, 50, 51, 52 when the partition is folded into the partially assembled knock-down flat (KDF) configuration. The notches help prevent any packaging present on the objects to be separated by the partition (for example, labels on a wine bottle) from becoming damaged during insertion of the partition and/or positioning of the objects within the partition. In other embodiments, notches 50-55 are not used at all.

As with blank 1, blank 20 may be folded into a knock-down flat (KDF) configuration using standard machinery, such as a standard flexo/folder/gluer machine In some embodiments, the standard flexo/folder/gluer applies glue or other suitable adhesive at glue areas 35, 36, 37, and 38. After applying the adhesive, the machine folds panel 23 over onto panel 22. The machine then folds panel 21 on top of panel 23 in its position on top of panel 22 to assemble the partition into the KDF configuration. The adhesive applied at glue areas 37, 38 bonds panels 22 and 23 together. The adhesive applied at glue areas 35 and 36 bonds panels 21 and 23 together. In some embodiments, the now partially assembled blank is then passed through a roller which applies pressure to the folded partition and further binds panel 22 to panel 23 and panel 21 to panel 23 at glue areas 35, 36, 37, and 38.

Figure 4:
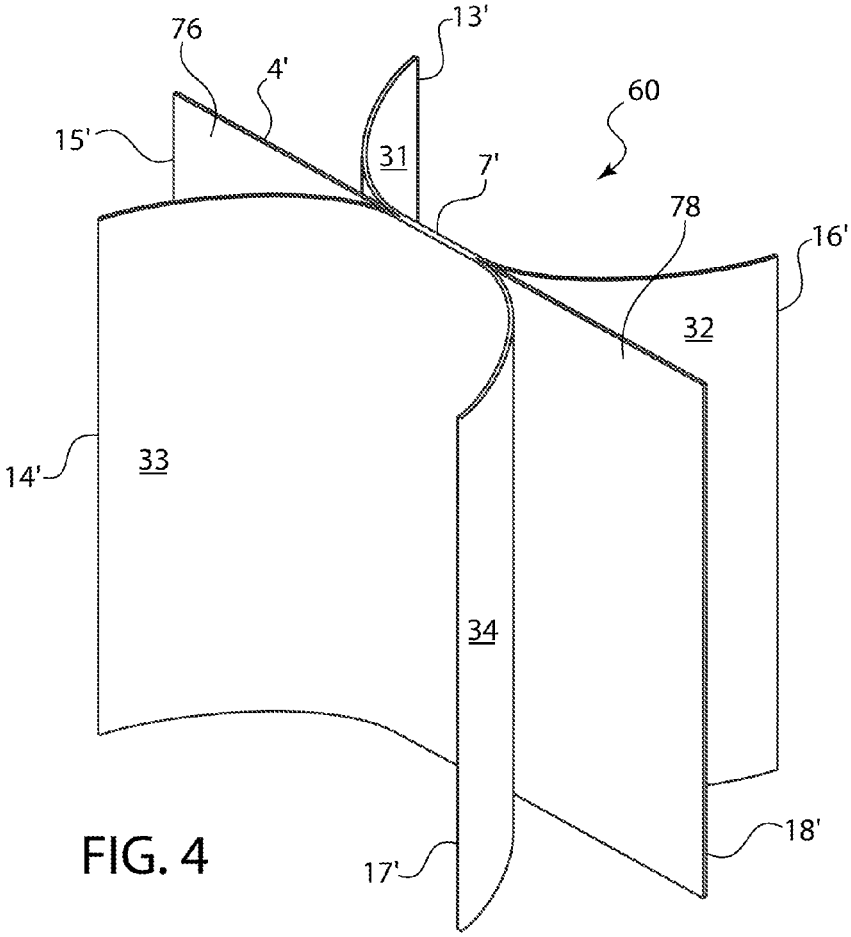
FIG. 4 is a perspective view of an erected partition formed from the blank of FIG. 1.

Turning to the embodiment shown in FIGS. 1 and 3-5, as shown in FIG. 4, panel 4' of erected partition 60 corresponds to panel 4 of blank 1 and acts as a center divider, with the center divider having a first portion 76 with an edge 15' corresponding to edge 15 of blank 1 of FIG. 1 and a second portion 78 with an edge 18' corresponding to edge 18 of blank 1 of FIG. 1. Erected partition 60 includes a plurality of flaps 31, 32, 33, and 34, which are used to separate objects, such as bottles or other product, within a container. Flap 31 of erected partition 60 includes edge 13', which corresponds to top edge 13 of panel 2 of blank 1 shown in FIG. 1 after it has been folded away from panel 4'. Flap 32 of erected partition 60 includes edge 16', which corresponds to bottom edge 16 of panel 2 of blank 1 in FIG. 1 after it has been folded away from panel 4'. Flap 33 of erected partition 60 includes edge 14', which corresponds to top edge 14 of panel 3 of blank 1 in FIG. 1 after it has been folded away from panel 4'. Flap 34 of erected partition 60 includes edge 17', which corresponds to bottom edge 17 of panel 3 of blank 1 in FIG. 1 after it has been folded away from panel 4'.

The partition 60 depicted in FIG. 4 may be erected and inserted into a container using standard or custom machinery. The machine receives the partition in its partially assembled knock-down flat position (as shown in FIG. 3) and, in one embodiment, positions the partition within the container so that fold line 7', which corresponds to fold line 7 of blank 1 in FIG. 1, is oriented upwards as shown in FIG. 4. The machine then creates flaps 31, 32, 33, 34 shown in FIG. 4 by manipulating edges 13', 14', 16', and 17' away from the center panel 4'. As shown in FIG. 4, the center panel 4' (which corresponds to panel 4 of blank 1 in FIG. 1) extends beyond edges 13', 14', 16', and 17', thus making it easier for the machine to separate the edges 13', 14', 16', 17' from the center panel 4' when forming flaps 31, 32, 33, and 34. The container may then be subsequently loaded with bottles or other objects to be separated by the partition.

Figure 5:
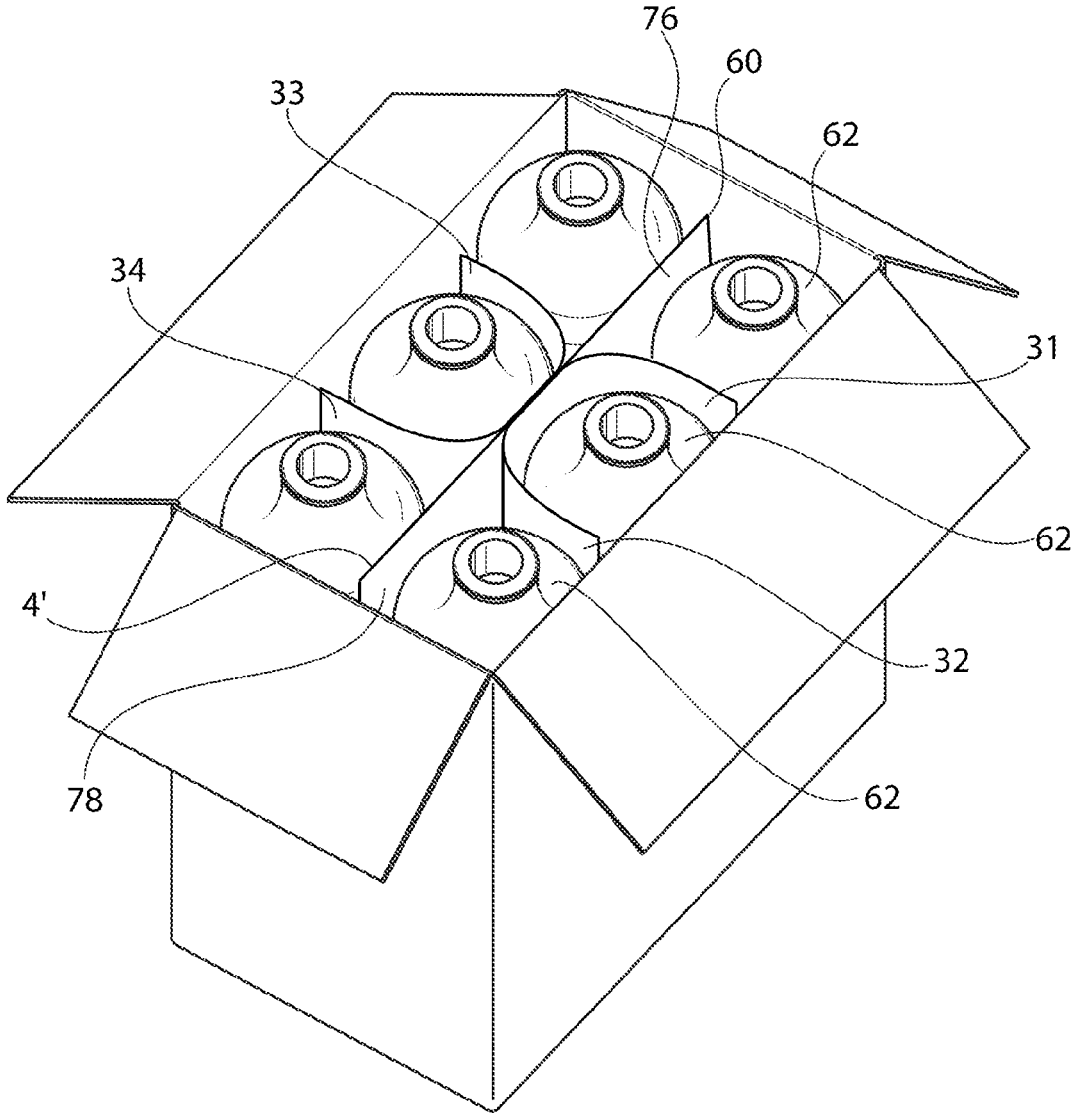
FIG. 5 is a perspective view of an erected partition formed from the blank of FIG. 1, inserted within a package and between a plurality of bottles.

Because the material of blank 1 is relatively thin, flaps 31, 32, 33, 34 are flexible and curvilinear in nature. The curvilinear nature of the flaps allows the flaps to conform to the size and shape of bottles or other product positioned within the partition (as shown in FIG. 5). Because the flaps conform to the contour of the bottle or other product positioned within the partition, partition 60 is capable of being used with various sized and shaped bottles or other product contained within partition. In this way, partition 60 may be used with wine or beer bottles or other product having different diameters, allowing the partition to be more universal.

Also provided is a method of erecting the partition 60 and positioning it within a container filled with bottles or other objects to be separated by the partition. According to one embodiment, as described above, a standard partition inserting machine erects (opens) the partition 60 by separating edges 13', 14', 16', 17' from center divider 4', fanning them out to form flaps 31, 32, 33, 34 and to create enough space to receive the neck of each bottle or other object to be separated by the partition. According to one embodiment, partition 60 is inserted into a container loaded with bottles or other objects to be separated by the partition. Specifically, the machine positions the partition 60 within the container so that the necks of the bottles (or other objects) within the container are each received within the space/cells created between flaps 31, 32, 33, and 34 and the center panel 4'. The machine then urges the partition downwards into the container, allowing the necks of the bottles to guide the flaps 31, 32, 33, 34 into their final resting position, as shown in FIG. 5. As described above, the final resting position of the flaps is determined by the shape of the bottles within the package as shown in FIG. 5. In this way, as described above, the curvilinear nature of the flaps allows for the partition to be universally used to separate bottles or other product of various sizes within a container. In other embodiments, the partition is manually erected and positioned within a container that is pre-loaded with bottles or other objects, or is manually erected and positioned within an empty container for subsequent loading of bottles or other objects to be separated by the partition.

FIG. 5 depicts erected partition 60 after it has been inserted within a container to separate a plurality of bottles. Specifically, partition 60 separates bottles 62 and helps prevent them from contacting one another. As shown in FIG. 5, partition 60 creates six cells for receiving bottles 62 where the size of each cell is determined by the diameter of each of the bottles or other product due to the curvilinear nature of the flaps 31, 32, 33, and 34. Specifically flap 34 and second portion 78 of center panel 4' form a first cell, flap 34 and flap 33 form a second cell, flap 33 and the first portion 76 of center panel 4' form a third cell, the first portion 76 of center panel 4' and flap 31 form a fourth cell, flap 31 and flap 32 form a fifth cell, and flap 32 and second portion 78 of center panel 4' form a sixth cell.

As mentioned above, the partition described above is capable of being formed, folded, erected, and loaded on standard equipment, thus reducing capital investment and labor costs. Reduced cost and assembly time is also achieved because erecting the partition does not involve gluing or complicated folding or other intricate steps. Moreover, the partition described is universal in nature and can accommodate objects having different dimensions, thus eliminating the need to stock different partitions for different products, which reduces inventory costs. The partition design also reduces paperboard waste, as the partition is configured so it does not lie flush against the sides of the container. In addition, in certain embodiments, the positioning of the glue area uses substantially less adhesive. In addition, in some embodiments, the leading edge of the erected and assembled partition (i.e., the partition edge that first enters the container when the partition is inserted) is generally wedge-shaped instead of generally straight, which provides an easier entry with less opportunity to damage product housed within the container and/or any labeling on product housed within the container due to reduced forces at the point of contact between the leading edge and the product housed in the container. For example, the third panel 4 or 23 that forms the center panels 76 or 78 is shown at one end of the blank so that the second panel 3 or 28 wraps round to meet one face of the third panel and the first panel 2 or 21 wraps in the same direction round to meet the other face of the third panel. In an alternative arrangement, the third panel 4 or 23 that forms the center panels 76 or 78 may be positioned in the center of the blank, with the second panel wrapping one way to meet one face of the third panel, and the first panel wrapping the other way to meet the other face of the third panel.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A partition formed from a single piece of foldable material comprising:

a first panel, a second panel, and a third panel configured such that the third panel is folded onto the second panel about a first fold line at an interface between the second and third panels and the first panel is folded onto the third panel about a second fold line at an interface between the first and second panels to provide a knock-down flat configuration with the first panel forming a first exterior layer, the second panel forming a second exterior layer, and the third panel forming a center layer, wherein:

the third panel is smaller than the second panel in a dimension generally perpendicular to the first and second fold lines such that a leading edge of the partition disposed at the second fold line is generally wedge-shaped with the first exterior layer disposed in face to face contact with the second exterior layer between a lower edge of the center layer and the second fold line;

the first panel forms a first flap and a second flap;

the second panel is adhered at least partially to the third panel so that the second panel forms a third flap and a fourth flap;

a first portion of the third panel corresponds to a first center panel and a second portion of the third panel corresponds to a second center panel;

the first flap and the first center panel define a first cell configured to receive a first item;

the first flap and the second flap define a second cell configured to receive a second item;

the second flap and the second center panel define a third cell configured to receive a third item;

the second center panel and the fourth flap together form a fourth cell configured to receive a fourth item;

the fourth flap and the third flap define a fifth cell configured to receive a fifth item; and the third flap and the first center panel define a sixth cell configured to receive a sixth item.

2. The partition of claim 1, wherein the foldable material is comprised of a flexible material so that the first, second, third, and fourth flaps are configured to generally conform to product housed in any of the first, second, third, fourth, fifth, or sixth cells.

3. The partition of claim 1, wherein the foldable material has a thickness of between approximately 15 thousandths of an inch and approximately 40 thousandths of an inch.

4. The partition of claim 1, wherein the first panel is adhered to the third panel.

5. The partition of claim 1, wherein the second panel is adhered to the third panel.

6. A single blank comprising:

a first panel that is adjacent a second panel that is adjacent a third panel;

a first score line that extends from an edge of the first panel to an edge of the second panel; and a second score line that extends from the edge of the first panel to the edge of the second panel, wherein the first and second score lines divide the first panel into a first portion, a second portion, and a third portion and divide the second panel into a fourth portion, a fifth portion, and a sixth portion, four of the portions defining flaps in an assembled partition, wherein:

the third panel is folded onto the second panel about a first fold line at an interface between the second and third panels and the first panel is folded onto the third panel about a second fold line at an interface between the first and second panels to provide a knock-down flat configuration for the assembled partition with the first panel forming a first exterior layer, the second panel forming a second exterior layer, and the third panel forming a center layer; and the third panel is smaller than the second panel in a dimension generally perpendicular to the first and second fold lines such that a leading edge of the partition disposed at the second fold line is generally wedge-shaped with the first exterior layer disposed in face to face contact with the second exterior layer between a lower edge of the center layer and the second fold line.

7. The blank of claim 6, wherein the first, second, and third panels each comprise top and bottom edges and wherein the top edge of the third panel extends beyond the top edges of the first and second panels and wherein the bottom edge of the third panel extends beyond the bottom edges of the first and second panels.

8. The blank of claim 6, wherein the blank has a thickness ranging from approximately 15 thousandths of an inch and approximately 40 thousandths of an inch.

9. The blank of claim 6, further comprising at least one glue area.

10. The blank of claim 6, wherein the fourth portion of the second panel is separated from an upper portion of the third panel by a first cut line.

11. The blank of claim 6, wherein the sixth portion of the second panel is separated from a lower portion of the third panel by a second cut line.

12. The blank of claim 6, wherein the first portion of the first panel is separated from the fourth portion of the second panel by a third cut line.

13. The blank of claim 6, wherein the second portion of the first panel is separated from the fifth portion of the second panel by a fold line.

14. The blank of claim 6, wherein the third portion of the first panel is separated from the sixth portion of the second panel by a fourth cut line.

15. The blank of claim 6, wherein the first and second score lines are perpendicular to the first and second fold lines.

* * * * *

UNITED STATES PATENT AND TRADEMARK OFFICE

CERTIFICATE OF CORRECTION

PATENT NO. : 8,991,685 B2
APPLICATION NO. : 13/670516
DATED : March 31, 2015
INVENTOR(S) : Ashley J. McPeak It is certified that error appears in the above-identified patent and that said Letters Patent is hereby corrected as shown below:

In the specification,

In column 4, line 27, delete “machine The” and insert -- machine. The --, therefor.

In column 5, line 41, delete “machine In” and insert -- machine. In --, therefor.

Signed and Sealed this
Seventeenth Day of May, 2016

Michelle K. Lee

Michelle K. Lee
*Director of the United States Patent and Trademark Office*